US012268276B2

(12) United States Patent
Reddy et al.

(10) Patent No.: US 12,268,276 B2
(45) Date of Patent: Apr. 8, 2025

(54) CUSHIONING FOR SHOE SOLE

(71) Applicant: Twisted X, Inc., Decatur, TX (US)

(72) Inventors: Prasad Reddy, Argyle, TX (US); Tuan Le, Portland, OR (US)

(73) Assignee: Twisted X, Inc., Decatur, TX (US)

( * ) Notice: Subject to any disclaimer, the term of this patent is extended or adjusted under 35 U.S.C. 154(b) by 0 days.

(21) Appl. No.: 17/718,861

(22) Filed: Apr. 12, 2022

(65) Prior Publication Data

US 2022/0232928 A1 Jul. 28, 2022

Related U.S. Application Data

(62) Division of application No. 16/407,972, filed on May 9, 2019, now Pat. No. 11,330,863.

(60) Provisional application No. 62/671,085, filed on May 14, 2018.

(51) Int. Cl.

| | |
|---|---|
| ***A43B 13/18*** | (2006.01) |
| ***A43B 1/00*** | (2006.01) |
| ***A43B 13/12*** | (2006.01) |
| ***A43B 13/42*** | (2006.01) |

(52) U.S. Cl.

CPC ..... *A43B 13/187* (2013.01); *A43B 1/0072* (2013.01); *A43B 13/125* (2013.01); *A43B 13/42* (2013.01)

(58) Field of Classification Search

CPC ..... A43B 13/187; A43B 13/188; A43B 13/42; A43B 13/125; A43B 13/127; A43B 1/0072

See application file for complete search history.

(56) References Cited

U.S. PATENT DOCUMENTS

| | | | | |
|---|---|---|---|---|
| 4,779,359 | A | 10/1988 | Famolare, Jr. | |
| 4,831,749 | A | 5/1989 | Tsai | |
| 4,970,807 | A | 11/1990 | Anderie et al. | |
| 5,005,300 | A * | 4/1991 | Diaz | A43B 13/203 36/31 |
| 5,402,588 | A | 4/1995 | Graham et al. | |
| 5,758,435 | A * | 6/1998 | Miyata | A43B 1/0009 36/25 R |
| 5,815,949 | A | 10/1998 | Sessa | |
| 6,061,928 | A * | 5/2000 | Nichols | A43B 13/181 36/28 |
| 8,316,560 | B2 | 11/2012 | Caron | |
| 11,330,863 | B2 * | 5/2022 | Reddy | A43B 13/187 |
| 2004/0093766 | A1 | 5/2004 | Hahn | |

(Continued)

*Primary Examiner* — Ted Kavanaugh

(74) *Attorney, Agent, or Firm* — Brian K. Yost; Decker Jones, PC

(57) ABSTRACT

An article of footwear has an upper, an outsole and a midsole. The outsole has upper and lower surfaces. The midsole has a midsole lower surface that contacts the upper surface of the outsole. The midsole has at least one cavity located in a heel or a forefoot portion, which cavity opens to a midsole upper surface. A cushion is located in the cavity. The cushion includes resilient balls located in a resilient matrix material. The balls have a first durometer and the matrix material has a second durometer that is different than the first durometer. The midsole has a lower cavity in the lower surface of the midsole, which lower cavity is aligned with an opening in the outsole. Balls are located in the lower cavity. A retainer keeps the balls in the lower cavity and provides a visual indication of the balls in the lower cavity.

13 Claims, 10 Drawing Sheets

(56) References Cited

U.S. PATENT DOCUMENTS

| | | | |
|---|---|---|---|
| 2005/0150132 | A1 | 7/2005 | Iannacone |
| 2005/0262726 | A1 | 12/2005 | Ferniani et al. |
| 2008/0060221 | A1 | 3/2008 | Hottinger |
| 2013/0239435 | A1 | 9/2013 | McDowell |

* cited by examiner

CUSHIONING FOR SHOE SOLE

This application claims the benefit of U.S. patent application Ser. No. 16/407,972 filed May 9, 2019 which is a regular application claiming the benefit of U.S. Provisional patent application Ser. No. 62/671,085 filed May 14, 2018, the contents of which are incorporated by reference herein in their entirety.

FIELD OF THE INVENTION

The present invention relates to footwear such as shoes, boots, and so on, and in particular to the soles thereof.

BACKGROUND OF THE INVENTION

Footwear comes in a variety of types and sizes, including sandals, shoes and boots. Footwear includes soles that protect and cushion the bottoms of the feet.

When walking, the heel of the foot strikes the ground first, followed by the forefoot. As the foot pushes off, the foot bends so that the heel rises and the forefoot is the last part to remain in contact with the ground. The heel takes the brunt of the force of the foot contacting the ground. Yet, the forefoot also experiences forces when the foot is landing on the ground and pushing off therefrom.

Much walking is done on hard surfaces, such as concrete, tile, etc. For example, walking on sidewalks and across streets involves concrete or asphalt surfaces. A shoe sole protects the foot from contact and abrasion with such hard surfaces.

In the prior art, Gaspard EU Patent No. 0383685 discloses a shoe sole with balls in the outsole. The balls are loosely provided in the outsole and are designed to move about.

It is desired to provide a shoe sole that provides improved protection and comfort.

SUMMARY OF THE INVENTION

An article of footwear comprises an upper configured to engage with a wearer's foot when the article of footwear is worn on the wearer's foot. A sole has a heel portion and a forefoot portion. The upper is connected to the sole, the sole having at least one cavity located in the heel portion or the forefoot portion. A cushion is located in the cavity, the cushion comprising resilient balls located in a resilient matrix material. The balls having a first durometer and the matrix material having a second durometer that is different than the first durometer.

In accordance with one aspect, the first durometer of the balls is greater than the second durometer of the matrix material.

In accordance with another aspect, the sole comprises an outsole and a midsole. The outsole has an upper surface and a lower surface that is configured to engage with a surface on which the wearer is striding. The midsole has a midsole lower surface that contacts the upper surface of the outsole. The midsole has the cavity that receives the cushion.

In accordance with another aspect, the midsole has a third durometer, the first durometer of the balls is less than the third durometer of the midsole.

In accordance with another aspect, the midsole has a forefoot cavity and a heel cavity, the heel cavity is separated from the forefoot cavity by a midsection of the midsole. The cushion comprises a heel cushion located in the heel cavity, further comprising a forefoot cushion located in the forefoot cavity, the forefoot cushion comprising balls in forefoot matrix material, with the durometer of the forefoot matrix material being different than the durometer of the balls in the forefoot cushion.

In accordance with another aspect, the balls in the forefoot cavity cushion are of a first diameter and the balls in the heel cavity cushion are of a second diameter, the first diameter being smaller than the second diameter.

In accordance with another aspect, the heel cavity is separated from the forefoot cavity by a midsection of the midsole.

In accordance with another aspect, the midsole comprises a lower portion located between the cushion and the outsole, the cavity being open to an upper surface of the midsole.

In accordance with another aspect, the balls in the cushion form a single layer of balls.

In accordance with another aspect, each of the balls in the cushion is interconnected with adjacent respective balls by spacing pins. The spacing pins creating gaps between adjacent respective balls, the matrix material being located in the gaps.

In accordance with another aspect, the matrix material substantially surrounds each of the balls in the cushion.

In accordance with another aspect, there is an upper cover over the cushion.

In accordance with another aspect, a lower cavity is in a lower surface of the sole. Balls are located in the lower cavity. A cover is over the lower cavity. The cover is at least translucent to provide a visual indication of the balls in the lower cavity. The cover is exposed to an exterior of the footwear.

In accordance with another aspect, the first durometer of the balls is greater than the second durometer of the matrix material. The sole comprises an outsole and a midsole. The outsole has an upper surface and a lower surface that is configured to engage with a surface on which the wearer is striding. The midsole has a midsole lower surface that contacts the upper surface of the outsole. The midsole has the cavity that receives the cushion. The midsole has a third durometer. The first durometer of the balls is less than the third durometer of the midsole. The balls in the cushion form a single layer of balls. Each of the balls in the cushion is interconnected with adjacent respective balls by spacing pins. The spacing pins create gaps between adjacent respective balls. The matrix material is located in the gaps. The midsole comprises a lower portion located between the cushion and the outsole. The cavity is open to an upper surface of the midsole.

An article of footwear comprises an upper configured to engage with a wearer's foot when the article of footwear is worn on the wearer's foot. An outsole has an upper surface and a lower surface that is configured to engage with a surface on which the wearer is striding. The outsole has an opening therein. A midsole has a midsole lower surface that contacts the upper surface of the outsole. The midsole has at least one cavity located in an upper surface and in a heel or a forefoot portion. The midsole also has a lower cavity that is adjacent to the opening in the outsole. A cushion is located in the cavity, the cushion comprising resilient balls located in a resilient matrix material. The balls have a first durometer and the matrix material having a second durometer that is different than the first durometer. Balls are located in the lower cavity. A retainer is over the lower cavity, the retainer retaining the balls in the lower cavity and being at least translucent to provide a visual indication of the balls in the lower cavity.

In accordance with another aspect, the outsole further comprises a protective tread member located below the lower cavity retainer.

DESCRIPTION OF THE PREFERRED EMBODIMENT

The present invention provides a cushioned shoe sole for footwear that is both comfortable and provides support to the foot. The shoe sole has cavities, which cavities contain resilient balls. The balls can be loose or encompassed within a resilient matrix material. The balls provide cushioning for the foot. The balls are typically hidden from view. A visual indication can be provided that the shoe sole contains cushioning balls.

The footwear includes shoes, boots and so on. Examples of footwear include casual shoes, recreational shoes, athletic shoes, outdoor shoes and dress shoes. Further examples of footwear include cowboy boots, western boots, riding boots, outdoor boots, hiking boots and work boots. Additional examples of footwear include specialty footwear such as military boots.

Figure 6:
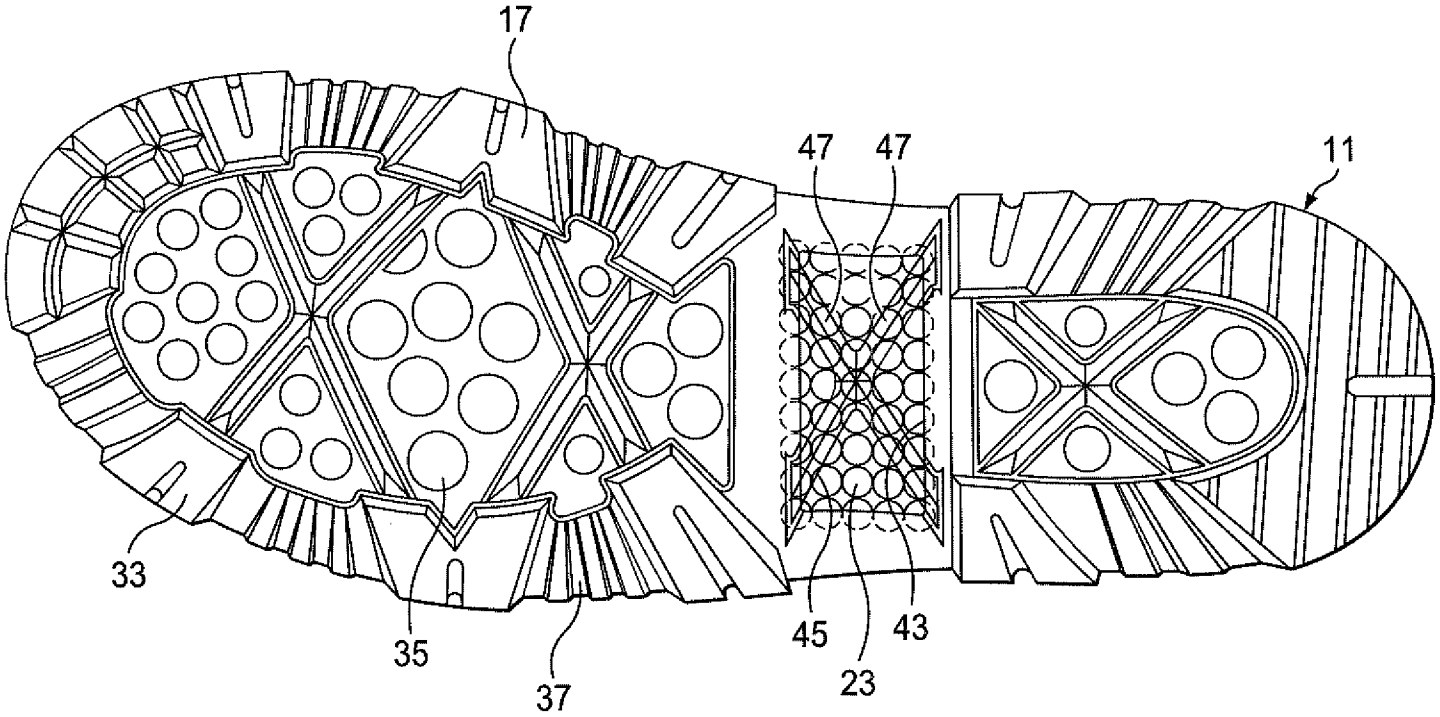
FIG. 6 is a bottom plan view of the shoe sole.
Figure 7:
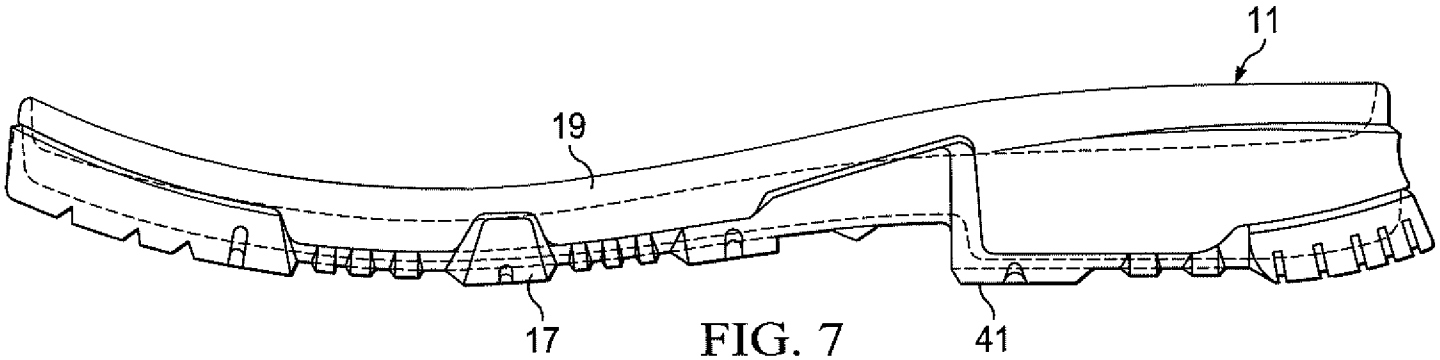
FIG. 7 is a side view of the shoe sole.
Figure 8:
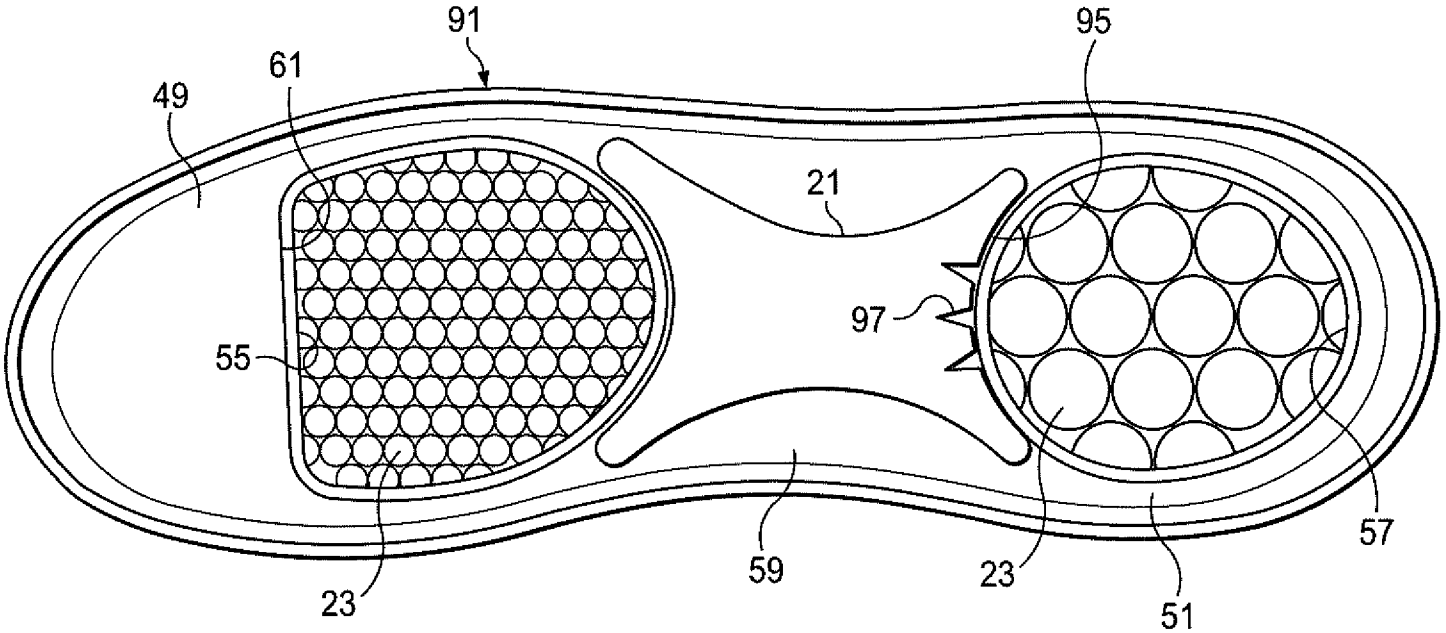
FIG. 8 is a top plan view of a shoe sole in accordance with another embodiment.
Figure 9:
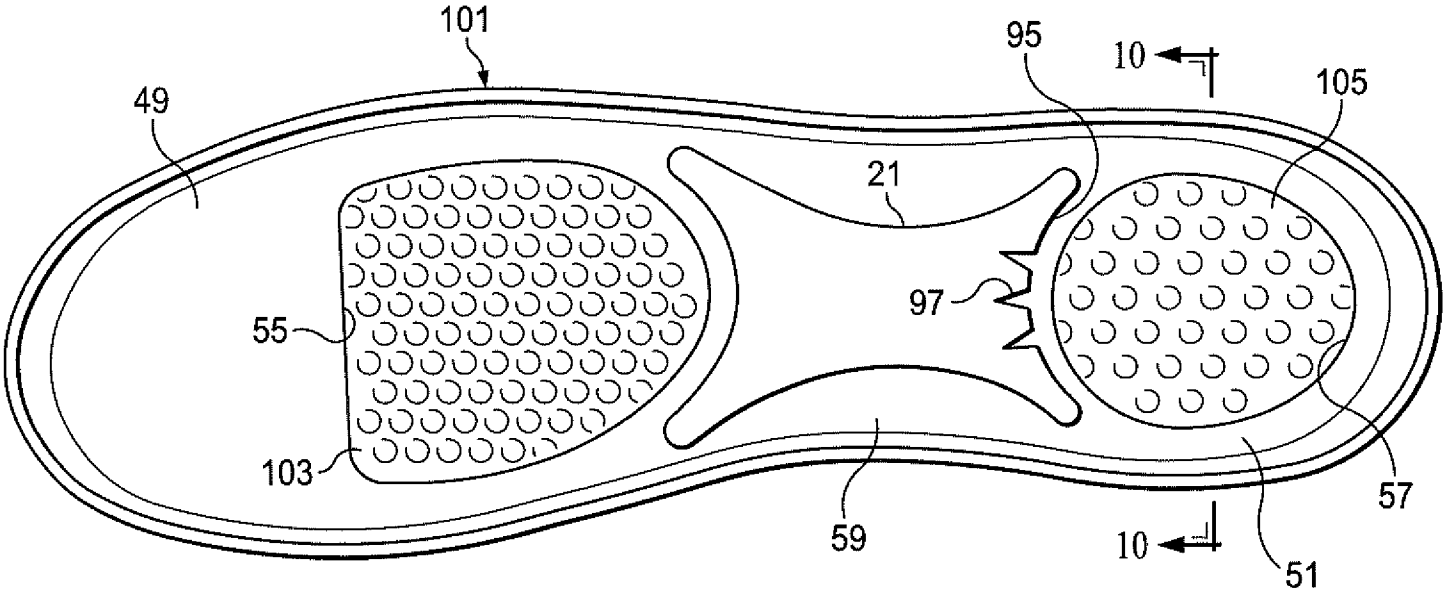
FIG. 9 is a top plan view of a shoe sole in accordance with still another embodiment.
Figure 10:
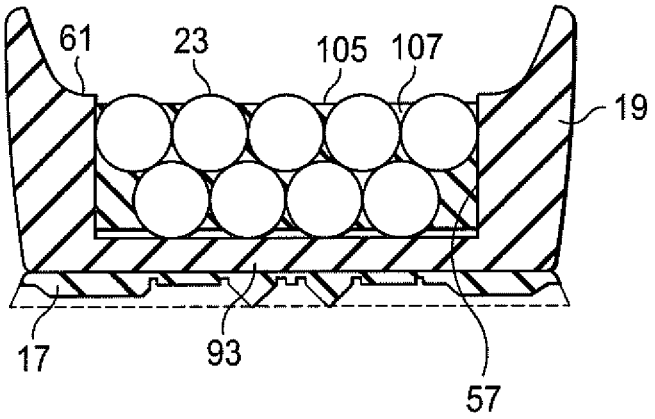
FIG. 10 is a cross-sectional view of the shoe sole, taken through lines X-X of FIG. 9.
Figure 11:
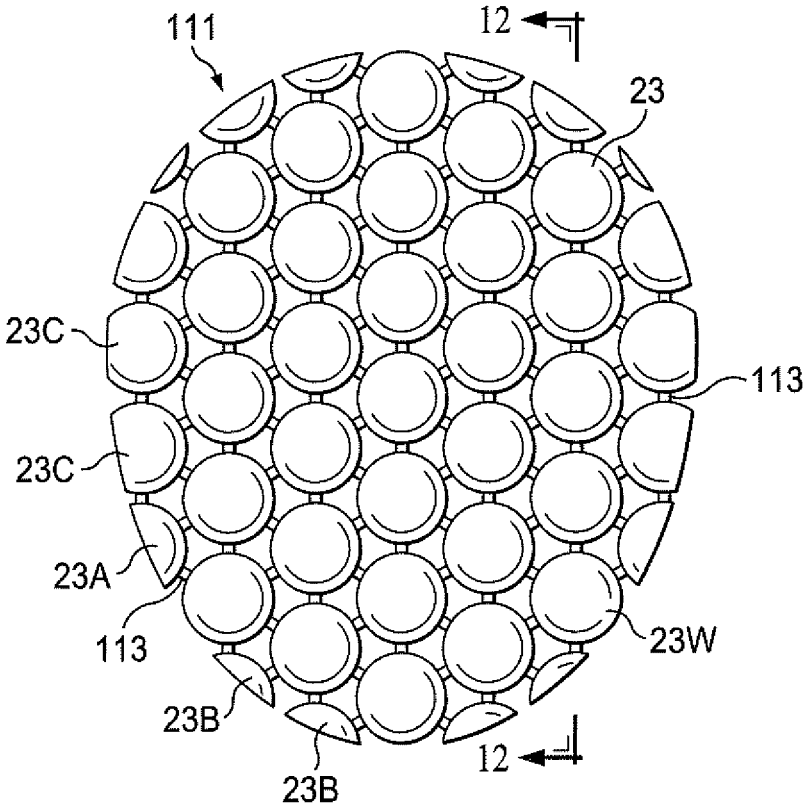
FIG. 11 is a top plan view of a ball assembly, in accordance with another embodiment.
Figure 12:
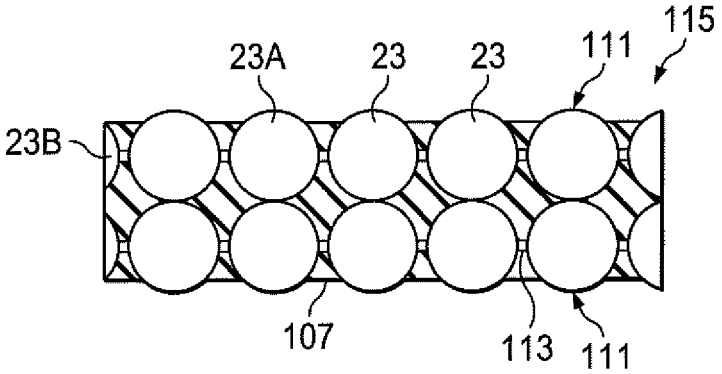
FIG. 12 is a cross-sectional view of a ball matrix, with the ball assembly of FIG. 11, taken along lines XII-XII of FIG. 11.

Several embodiments are described herein, with FIGS. 1-7 showing a first embodiment, FIG. 8 showing a second embodiment, FIGS. 9-10 showing a third embodiment and FIGS. 11-12 showing a fourth embodiment.

Referring to FIGS. 1-7, the shoe sole 11 is part of a piece of footwear 15. The shoe sole 11 includes an outsole 17, a midsole 19, an insert 21, balls 23 and cavity covers 25. The outsole 17 is the part of the sole that contacts the ground. The midsole 19 is located above the outsole 17. The insert 21 and cavity covers 25 are located in the midsole and the balls 23 are located in cavities 55, 57 in the midsole. The footwear 15 also includes an upper 27. The upper typically has an insole. The upper 27 is secured to the upper part of the midsole.

As used herein, the terms "upper", "lower", "top" and "bottom" and similar terms as used to describe spatial relationships between components of the footwear and/or between a component of the footwear and the ground. Such terms are relative to the footwear positioned in an upright orientation on a ground surface. "Ground" includes interior floors and exterior surfaces such as streets, sidewalks, soil, etc.

The outsole 17 extends the length of the shoe and has an upper surface 31 and a lower surface 33. The lower surface 33 contacts the ground when the shoe is worn in normal use. The lower surface is configured to engage with the ground or other surface upon which the wearer of the shoe is striding or walking. The lower surface 33 is typically provided with a tread pattern, an example of which is shown in FIG. 6. The tread pattern may include a distinct tread structure, such as including a non-smooth surface, and in some embodiments including tread projections 35, tread channels 37, and the like. The lower surface may also be smooth in some or all areas.

The upper surface 31 is typically smooth, although need not be so. In one embodiment, the upper surface can be pockmarked with craters or shallow depressions, which depressions correspond to circular shaped projections 35 on the lower surface. The outsole may have upwardly extending side projections 39, which projections couple to the sides of the midsole. Such side projections 39 are located at the toe of the outsole, at the heel, and at locations between the toe and heel.

Figure 2:
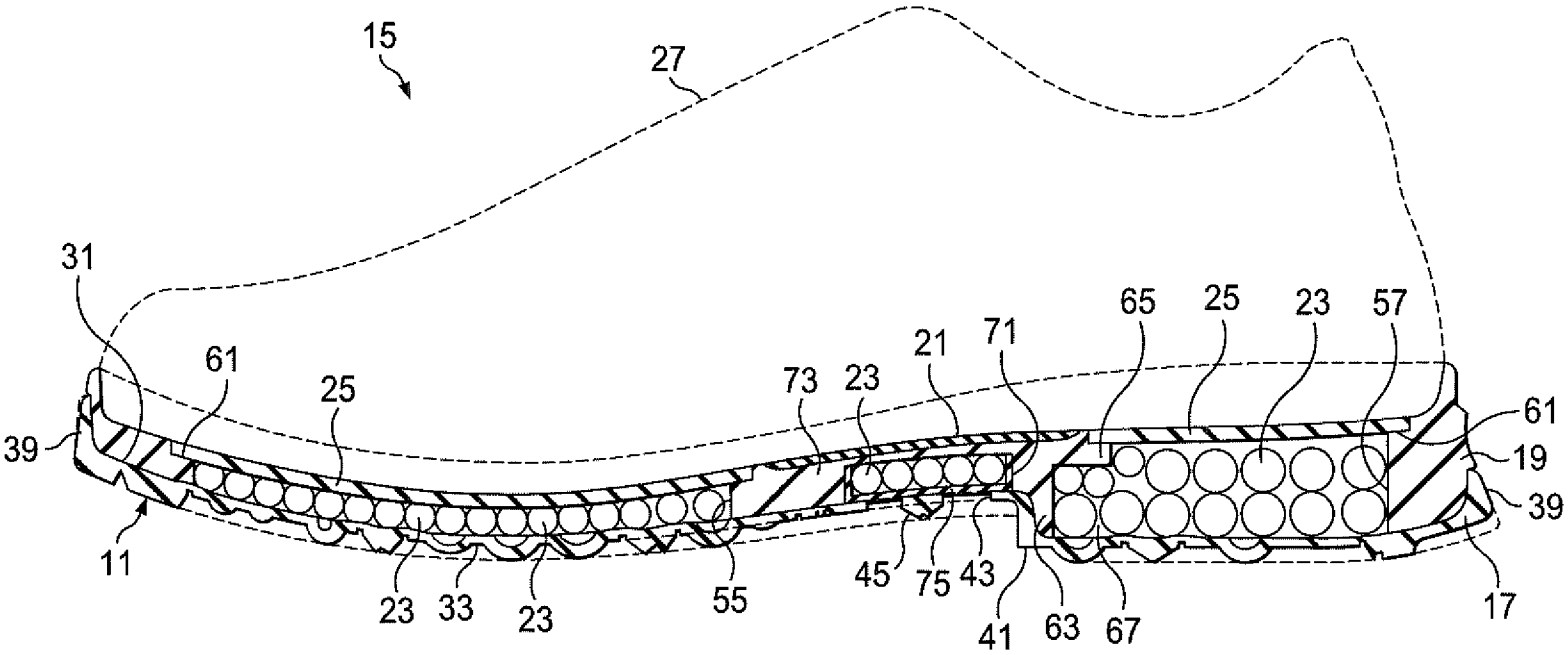
FIG. 2 is a cross-sectional view of the shoe sole, taken through lines II-II of FIG. 1.
Figure 3:
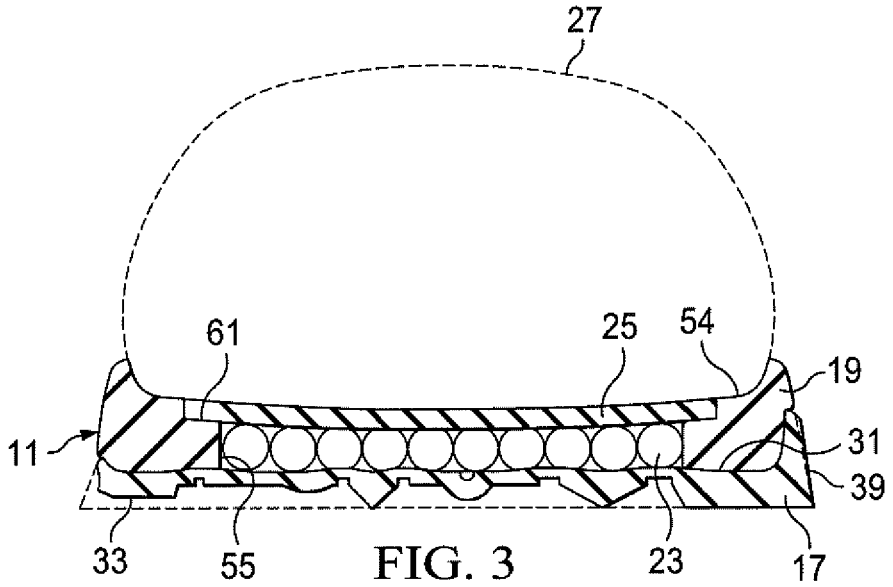
FIG. 3 is a cross-sectional view of the shoe sole, taken through lines III-III of FIG. 1.

The footwear includes a heel 41 (see FIGS. 2, 6 and 7). In the embodiment shown, the heel 41 is of the projecting type. Alternatively, the heel can be flat.

Figure 4:
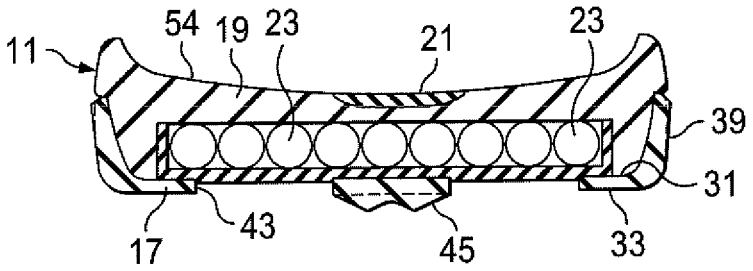
FIG. 4 is a cross-sectional view of the shoe sole, taken through lines IV-IV of FIG. 1.

The outsole 17 has an opening 43 therethrough, which opening is located forward of the heel 41 (see FIGS. 2, 4 and 6). In the preferred embodiment, the opening 43 is wider (side to side relative to the shoe sole) than it is long (toe to heel dimension). In the preferred embodiment shown, the opening 43 is rectangular in shape. The opening may be overlaid with tread 45. In the preferred embodiment, the overlay tread 45 is an "X" that has legs 47 that extend across diagonally opposite corners. When viewed in transverse cross-section (see FIG. 4), the legs 47 are triangular, having a flat base as an upper surface and an apex along the lower surface to create an edge. (FIG. 4 shows a cross-section of the intersection of the two legs 47.)

The midsole 19 is sized and shaped to fit on top of the outsole 17 and the side projections 39 (see FIGS. 1-5). The midsole 19 has a toe portion 49, a heel portion 51 and side portions 53. The midsole has an upper surface 54. The midsole has a forefoot cavity 55 and a heel cavity 57. The forefoot cavity 55 and the heel cavity 57 are separated from one another by a midsection 59. Each of the cavities is open on the bottom and on the top. Each of the cavities has a lip 61 (see FIGS. 1 and 2) around the upper edge, which lip receives a respective cavity cover 25.

The forefoot cavity 55 (see FIGS. 1-3) is generally oblong, extending from the toe portion 49 of the midsole to the midsection 59 and from one side portion 53 to the opposite side portion 53.

The heel cavity 57 (see FIGS. 1, 2 and 5) extends from the heel portion 51 to the midsection 59 and from one side portion to the opposite side portion. The midsole has a front wall 63 at the heel cavity. The depth of the heel cavity 57 is greater than the depth of the forefoot cavity 55. The heel cavity has a projecting lip 65 that extends from the front of the cavity towards the heel for a distance. The lip 65 forms an extension of the upper surface 54 of the midsole to support the insert 21. A front portion 67 of the heel cavity is located under the lip. The lip 65 has a curved rear edge 69. The lip 65 is optional and is not provided in the embodiments of FIGS. 8-12.

Figure 1:
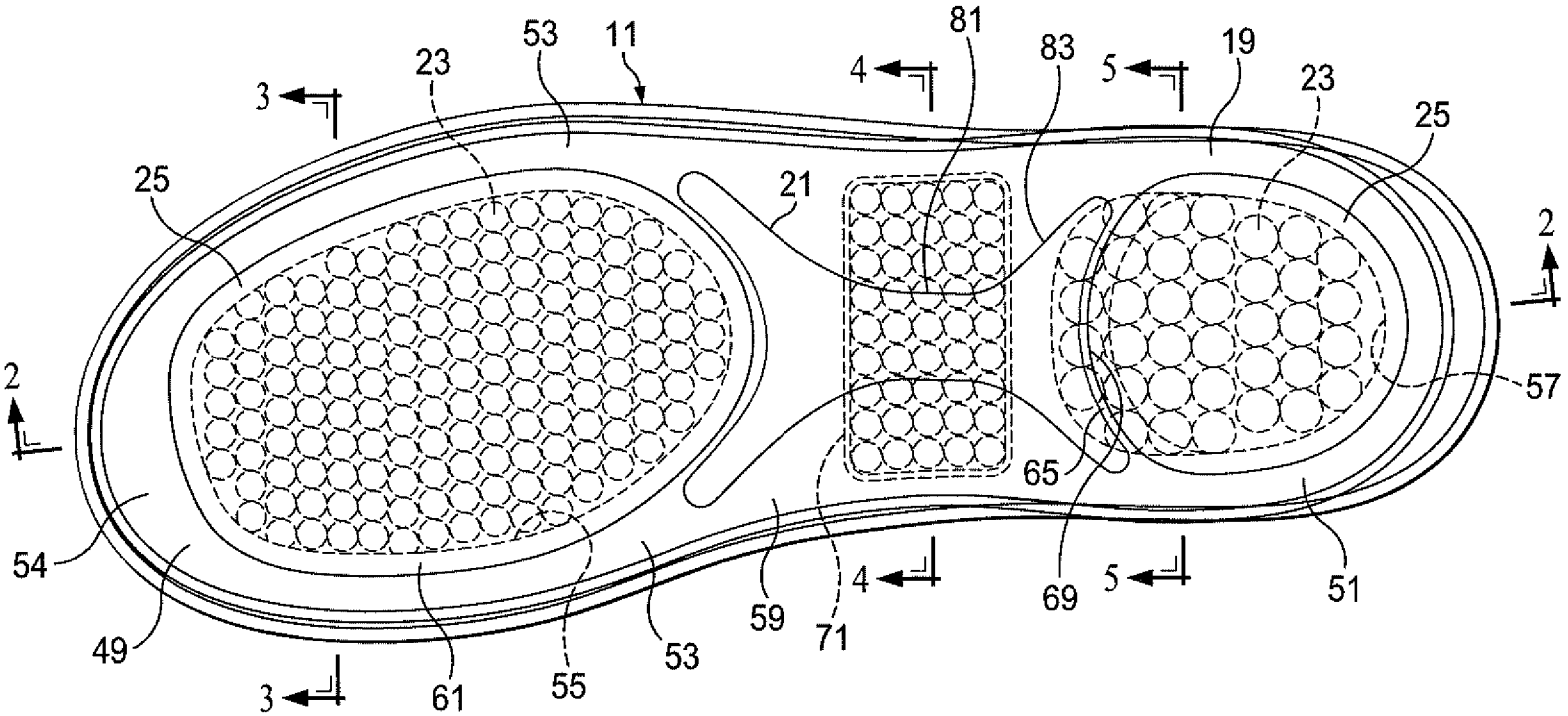
FIG. 1 is a top plan view of a shoe sole of the present invention, in accordance with a preferred embodiment.

The midsole 19 has a midsection cavity 71 as well (see FIGS. 1, 2 and 4). The midsection cavity 71 is open at the bottom and has a closed top. Alternatively, the midsection cavity 71 can be closed at the bottom and open at the top. The midsection cavity is sized and located so as to correspond to the opening 43 in the outsole 17.

The midsole has an insert cavity 73 (see FIG. 4) in its midsection, which insert cavity is located on the upper surface thereof. The insert cavity 73 receives the insert 21 (the insert is discussed in more detail below).

A cover element 75 is provided to cover the bottom of the midsection cavity 71. The cover element 75 is transparent to allow viewing of the interior of the midsection cavity. Alternatively, the cover element can be translucent. If the midsection cavity 71 is closed at the bottom, then the bottom wall of the cavity is either transparent or translucent.

When the midsole 19 is coupled to the outsole 17, the bottoms of the forefoot and heel cavities 55, 57 are closed by the outsole.

Referring to FIGS. 1-5, the forefoot cavity 55, the heel cavity 57 and the midsection cavity 71 contain balls 23 or spheres. The balls 23 are solid and are made of a resilient material such as thermoplastic rubber (TPR), polyurethane (PU), polyethylene or ethylene-vinyl acetate rubber (EVA). The Shore C hardness is between 40-68. The balls 23 in the forefoot cavity 55 are smaller than the balls in the heel cavity 57. Actual size of the balls depends on shoe size (with larger shoe sizes having larger balls than smaller shoe sizes). For example, the balls in the forefoot cavity 55 can be 4-12 mm in diameter, while the balls in the heel cavity 57 can be 8-18 mm in diameter.

Figure 5:
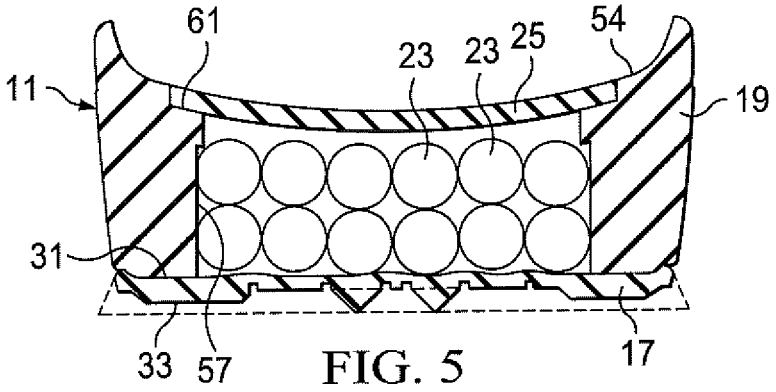
FIG. 5 is a cross-sectional view of the shoe sole, taken through lines V-V of FIG. 1.

The forefoot cavity 55 has a single layer of balls 23. The heel cavity 57 has either a double layer, or a single layer, of balls 23. The balls are in contact with one another, although the balls are not deformed by the contact. In the heel cavity, the upper layer of balls can be arranged as shown in FIGS. 2 and 5, where the upper balls are directly on top of the lower balls. Alternatively, the upper balls can be offset so as to be located between the upper regions of the lower balls.

Once the balls have been placed into the cavities 55, 57, the cavities are closed with the respective cavity covers 25.

The midsection cavity 71 has a single layer of balls 23. The midsection cavity is primarily to allow the user to visually see that the shoe sole contains balls. The forefoot cavity 55 and heel cavity 57 are closed off from viewing once the shoe is completed. Because of its location under the insert 21, the balls in the midsection cavity 71 do not serve a significant role in cushioning the foot.

The insert 21 is shaped like an "X", having a central shank portion 81 and arms 83 extending therefrom. The central portion 81 of the insert is elongated and extends over the midsection cavity. The front arms 83 form a curved shape that extends about the heel end of the forefoot cavity 55. Likewise, the rear arms 83 form a curved shape that extends about the toe end of the heel cavity 57. The rear arms overlay the lip 65. The insert 21 is thin. A section of midsole 19 is between the insert 21 and the midsection cavity 71.

The outsole 17 is preferably made of synthetic or natural rubber, while the midsole 19 is preferably made of EVA or PU. The insert 21 is preferably made of thermoplastic urethane. The midsole is softer than the outsole and the insert. The outsole is softer and more flexible than the insert. Typically, the outsole 17 has a Shore A hardness of 62-72. Safety toe shoes have harder outsoles than do soft toe shoes. Typically, the midsole 19 has a Shore C hardness of 55-60. The insert 21 hardness is typically Shore D 73-77.

To assemble the shoe sole, the insert 21 is glued into the insert cavity 73 on the midsole. The top surface of the insert 21 is flush with the upper surface 54 of the midsole. Balls are put into the midsection cavity 71 and the cover 75 is glued over the cavity. In one embodiment, the balls in the midsection cavity 71 are smaller in diameter than the balls in the forefoot and heel cavities 55, 57. Then, the midsole 19 is coupled to the outsole 17 by adhesive. The tread 45 overlays and retains the cover 75, while permitting viewing of the balls 23 inside the midsection cavity. (In FIG. 6, the tread legs 47 overlay and obscure the balls 23 from view; the balls are shown in solid lines for simplicity.)

With the midsole coupled to the outsole, the bottoms of the forefoot and heel cavities 55, 57 are closed. Balls 23 are placed into each cavity. As noted above, the balls in the forefoot cavity are smaller in diameter than the balls of the heel cavity. The balls in the forefoot cavity form a single layer and are abutting one another. The balls in the heel cavity are in two layers. The bottom layer of balls extends under the projecting lip 65. The balls in each layer are abutting one another. The balls 23 in each cavity are loose and not attached to one another. The tops of the balls 23 in each cavity are flush with the lip 61. Thus, in the preferred embodiment, the balls 23 do not protrude out of the top of each cavity.

Once the balls are positioned, the cavities are closed with the covers 25. The covers are glued to the lips 61. The top surfaces of the covers 25 are flush with the upper surface 54 of the midsole.

The sole is now assembled. The upper is attached to the sole to complete the shoe.

In use, when foot pressure is not applied to the sole, the balls are generally spherical in shape. As foot pressure is applied the sole, the balls 23 compress down. Foot pressure is unevenly distributed across the top of the sole. The heel area experiences higher pressure than the forefoot area and midsection area. The forefoot area experiences higher pressure than the midsection area. However, the foot pressure applied to the forefoot area is typically uneven, with the balls of the feet producing a higher pressure on the sole than the other forefoot areas. The balls under the highest foot pressure compress more. As the foot pressure is released, such as during walking when the foot is raised to take the next step, the balls resume their spherical shape. The wearer thus experiences softened steps. If walking over a hard ground surface such as concrete, the wearer's feet are protected from the hardness of the ground.

Even though the balls 23 in the forefoot and heel cavities 55, 57 are hidden from view, the balls in the midsection cavity 71 are visible through the cover element 75. Thus, a customer, when shopping for shoes, can view the balls and visually affirm that the shoe sole 11 contains balls.

FIG. 8 shows another embodiment of the shoe sole 91. The forefoot and heel cavities 55, 57 are closed on the bottom by a bottom wall 93 (see FIG. 10). Thus, if the outsole 17 should wear through, then the balls 23 are retained in the cavities 55, 57 by the respective bottom wall 93.

The forefoot cavity 55 has a different size and shape in FIG. 8 than in FIG. 1. In FIG. 8, the forefoot cavity is shaped like a partial, or truncated, oval. The forefoot cavity is shorter in length, extending from the midsection toward the toe portion 49. The toe portion 49 is much larger in area than in the embodiment of FIG. 1. The balls of the foot bear on the balls 23, while the toes bear on the toe portion.

The heel cavity 57 in FIG. 8 lacks the protruding lip 65. Thus, the insert 21 is supported by the material of the midsole midsection.

The insert 21 of FIG. 8 has a central shank 81 that is wider than in the embodiment of FIG. 1. The insert 21 has a toe-to-heel length as measured along the center of the shoe sole. The width of the central shank 81 in FIG. 8 is about half of the length of the insert. In contrast the width of the central shank 81 in FIG. 1 is about one-sixth to one-seventh the length of the insert.

The insert 21 has a rear edge 95. Notches 97 are formed in the rear edge 95, along the central shank. In the preferred embodiment, there are three notches 97, which extend for a short distance into the central shank. These notches 97 allow the rear edge 95 to be flexible, resulting in a softer fit. When a user puts weight on the foot in the shoe, the rear edge 95 flexes down due to pressure from the heel. This is a more comfortable feeling when compared to an un-notched rear edge, which has less movement.

FIGS. 9 and 10 show another embodiment of the shoe sole 101. The shoe sole is provided with cushions that include ball matrices. The ball matrices capture the balls and prevent the movement of the balls with respect to each other. The ball matrices provide the flexibility of the balls 23 and the surrounding matrix material. There is a forefoot ball matrix 103 and a heel ball matrix 105. The forefoot ball matrix 103 is sized and shaped to fit within, and fill, the forefoot cavity 55. The heel ball matrix 105 is sized and shaped to fit within, and fill, the heel cavity 57. The top surface of each ball matrix 103, 105 is flush with the respective lip 61. Each ball matrix 103, 105 has the balls 23 encased in a flexible matrix material 107. The matrix material 107 fills the spaces between the balls 23, thereby preventing the balls from moving with respect to one another. The tops and bottoms of the balls are visible at the respective top and bottom surfaces of the matrix. This allows the resiliency of the balls to be utilized when foot pressure is applied. Covering the tops and bottoms of the balls with matrix material would dampen the resiliency of the balls, as the matrix material would absorb more of the foot pressure. The matrix material 107 is made of a flexible and resilient material such as polyurethane. The durometer of the matrix material 107 is Shore C 30-50. There is a differential in durometers between the balls and the matrix material, with the balls being harder. For example, if the matrix material has a Shore C durometer of 30-39, the durometer of the balls is Shore C 40-68. Continuing with the example, if the matrix material has a Shore C durometer of 40-45, then the durometer of the balls is Shore C 46-68.

To make the ball matrices 103, 105, the balls 23 are placed into a respective mold. For the forefoot ball matrix 103, the balls are typically arranged in a single layer. For the heel ball matrix 105, the balls are typically arranged in a double layer. The respective mold is then filled with the matrix material 107. In the preferred embodiment, the matrix material covers substantially all of the surface area of the balls. As shown in FIGS. 9, 10 and 12, the top portions and bottom portions of the balls are not covered by the matrix material. Likewise, the balls on the edge of the ball matrix have exposed surfaces that are not covered by the matrix material. Once the matrix material has cured, the ball matrix 103, 105 is removed from the mold and inserted into the respective cavity 55, 57. The cavity covers 25 (not shown in FIGS. 9-10) are placed over the ball matrices, on the lips 61.

The provision of the matrix material maintains the relative positions of the balls with respect to one another, while still allowing the balls to compress under foot pressure and resume a spherical shape when foot pressure is removed. In this manner, the balls do not shift or move. In addition, the matrix material provides cushioning and resiliency in addition to the balls, adding to the overall cushioning of the sole. As foot pressure is applied to the sole, the ball matrix compresses. Thus, the balls and the matrix material compress under the foot pressure. When foot pressure is removed, the balls and matrix material decompress.

FIG. 11 illustrates another embodiment of the balls 23, which form a ball assembly 111. While the balls in the previous embodiments contact the adjacent balls in the same layer, in FIG. 11, the balls 23 are slightly spaced apart from one another. Each ball assembly has a layer of balls connected together. Each ball is connected to the adjacent balls by pins 113 (or rods). For example, a ball surrounded by six other balls is connected to each adjacent ball by a pin 113, for a total of six pins. The pins 113 are solid and serve several purposes. One purpose is during manufacturing. The ball assembly is injection molded and the pins serve as sprues to connect ball cavities together in the mold. Another purpose is for assembly; the ball assembly can be placed inside of a cavity with the balls correctly positioned and intact. This assures that each shoe has the correct number and placement of balls in the respective cavity. In the case of the heel cavity, if two layers of balls are used, then two ball assemblies are used, namely an upper ball assembly and a lower ball assembly. The spacing is small relative to the size of the balls. For example, with balls of 4-12 mm diameter, the spacing between balls is 1-2 mm. For balls of 8-18 mm, the spacing between balls is 2-3 mm.

The ball assemblies 111 include whole balls 23W and partial balls. Whole balls are of course complete spheres. Partial balls are less than whole spheres. The partial balls are located around the periphery of the ball assembly. For example, as shown in FIG. 11, one or more balls 23A are an approximate hemisphere. A hemisphere may be connected to three adjacent balls. Other balls 23B are less than a hemisphere; such balls are connected to two adjacent balls. Still other balls 23C are more than a hemisphere, but less than a complete sphere; such balls are connected to four adjacent balls.

The provision of partial balls 23A, 23B, 23C along the periphery of the ball assembly 111 allows for a staggered fit of the balls with respect to one another and also allows for filling spaces along the periphery of the ball assembly when inserted into a respective cavity 55, 57, 71. The balls 23 are staggered in fit as shown in FIG. 11 (and also FIGS. 1 and 8). The balls in one row are staggered or offset with respect to the balls in an adjacent row (FIG. 12 is a cross-section taken through a row of balls). Thus, the balls in one row are aligned with the spaces between the balls in an adjacent row. Such a staggered arrangement allows a ball to be connected to six adjacent balls by way of pins. A non-staggered arrangement, such as an aligned arrangement, has the balls in a ball assembly aligned in rows and columns, where each ball would be connected to four adjacent balls by way of pins. A staggered arrangement allows for a closer fit of the balls than does an aligned arrangement.

The forefoot and heel cavities 55, 57 are shaped in a non-geometrical manner. That is to say, the cavities, when viewed in plan view from the top, are not circular or oval in shape. The cavities are shaped to the foot. By providing partial balls 23A, 23B, 23C, the balls in the ball assembly can fit within the cavities. The partial balls serve to fill much of the peripheral space between the whole balls and the cavity walls.

FIG. 12 shows the ball assembly of FIG. 11 (actually two layers of ball assemblies) in a ball matrix 115. The spaces between the balls are filled with the matrix material 107. Thus, the matrix material adds to the overall resiliency of the ball matrix. The tops, bottoms and sides of the balls are exposed and uncovered by the matrix material. The ball matrix is made in a mold. The ball assembly or assemblies are located in the mold and the mold filled with the matrix material. The resulting ball matrix has the same shape as the respective cavity 55, 57. Once the matrix material cures, the ball matrix 115 can be inserted into the respective cavity. The balls 23 in the midsection cavity 71 can either be left without matrix material 107, or encased therein.

The pins 113 may disconnect or break away from the balls 23 when the shoe sole is in use. If the ball assembly is in a matrix, the balls remain fixed in place by the matrix material 107. If the balls are not in a matrix, then the balls can move slightly relative to the other balls. However, the relative positions of the balls remain unchanged. For example, the balls in one row can move about between the adjacent rows.

The balls 23 of FIGS. 1-8, the ball matrices 103, 105 of FIGS. 9-10, the ball assembly 111 of FIG. 11 and the ball matrix 115 of FIG. 12 are inserts added to the midsole cavities 55, 57 and have different durometers than the midsole 19.

The foregoing disclosure and showings made in the drawings are merely illustrative of the principles of this invention and are not to be interpreted in a limiting sense.

We claim:

1. An article of footwear, comprising:

a) An upper configured to engage with a wearer's foot when the article of footwear is worn on the wearer's foot;

b) A sole having a heel portion and a forefoot portion, the upper connected to the sole, the sole having at least one cavity located in an upper surface of the sole and in the heel portion or the forefoot portion;

c) A cushion located in the cavity, the cushion comprising resilient balls located in a resilient matrix material, the balls having a first Shore C hardness and the matrix material having a second Shore C hardness that is different from the first Shore C hardness;

d) An upper cover, the upper cover being positioned over the cushion;

e) The sole further comprising a lower cavity in a lower surface of the sole;

f) Balls located in the lower cavity;

g) A retainer positioned below the lower cavity, the retainer retaining the balls in the lower cavity and being at least translucent to provide a visual indication of the balls in the lower cavity, the retainer exposed to an exterior of the footwear;

h) A protective tread member positioned below the lower cavity retainer, the protective tread member comprising legs extending diagonally across the retainer to opposite corners of the retainer.

2. The article of footwear of claim 1, wherein the first Shore C hardness of the balls is greater than the second Shore C hardness of the matrix material.

3. The article of footwear in claim 1, wherein the sole comprises an outsole and a midsole, the outsole having an upper surface and a lower surface that is configured to engage with a surface on which the wearer is striding, the outsole having an opening therein; the midsole having a midsole lower surface that contacts the upper surface of the outsole, the midsole having the cavity that receives the cushion, the midsole also having a lower cavity that is adjacent to the opening in the outsole.

4. The article of footwear of claim 3, wherein the midsole comprises a lower portion located between the cushion and the outsole, the cavity being open to an upper surface of the midsole.

5. The article of footwear of claim 3, wherein the midsole has a third Shore C hardness, the first Shore C hardness of the balls is less than the third Shore C hardness of the midsole.

6. The article of footwear of claim 3, wherein the midsole has a forefoot cavity and a heel cavity, the heel cavity separated from the forefoot cavity by a midsection of the midsole, the cushion comprising a heel cushion located in the heel cavity, further comprising a forefoot cushion located in the forefoot cavity, the forefoot cushion comprising balls in forefoot matrix material, with the Shore C hardness of the forefoot matrix material being different from the Shore C hardness of the balls in the forefoot cushion.

7. The article of footwear of claim 6, wherein the balls in the forefoot cavity cushion are of a first diameter and the balls in the heel cavity cushion are of a second diameter, the first diameter being smaller than the second diameter.

8. The article of footwear of claim 6, wherein the heel cavity is separated from the forefoot cavity by a midsection of the midsole.

9. The article of footwear of claim 1 wherein the balls in the cushion form a single layer of balls.

10. The article of footwear of claim 9, wherein each of the balls in the cushion is interconnected with adjacent respective balls by spacing pins, the spacing pins creating gaps between adjacent respective balls, the matrix material being located in the gaps.

11. The article of footwear of claim 1, wherein the matrix material substantially surrounds each of the balls in the cushion.

12. The article of footwear of claim 1, further comprising:

a) the first Shore C hardness of the balls is greater than the second Shore C hardness of the matrix material;

b) the sole comprises an outsole and a midsole, the outsole having an upper surface and a lower surface that is configured to engage with a surface on which the wearer is striding, the midsole having a midsole lower surface that contacts the upper surface of the outsole, the midsole having the cavity that receives the cushion;

c) the midsole has a third Shore C hardness, the first Shore C hardness of the balls is less than the third Shore C hardness of the midsole;

d) the balls in the cushion form a single layer of balls;

e) each of the balls in the cushion is interconnected with adjacent respective balls by spacing pins, the spacing pins creating gaps between adjacent respective balls, the matrix material being located in the gaps;

f) the midsole comprises a lower portion located between the cushion and the outsole, the cavity being open to an upper surface of the midsole.

13. The article of footwear of claim 1, wherein the cavity located in the upper surface of the sole further comprises a recessed perimeter lip adapted to receive the upper cover.

* * * * *